United States Patent [19]

Taber et al.

[11] Patent Number: 4,607,768

[45] Date of Patent: Aug. 26, 1986

[54] DISPENSING CLOSURE WITH LATCH MECHANISM

[75] Inventors: James M. Taber; Stephen J. Kras, both of Chicago, Ill.

[73] Assignee: Continental White Cap, Inc., Northbrook, Ill.

[21] Appl. No.: 633,320

[22] Filed: Jul. 23, 1984

[51] Int. Cl.[4] ..... B65D 47/00

[52] U.S. Cl. ..... 222/556; 222/517; 222/498; 215/237

[58] Field of Search ..... 222/563, 543, 565, 480, 222/517, 556, 498, 511, 540, 545, 153; 215/235, 237

[56] References Cited

U.S. PATENT DOCUMENTS

| | | | |
|---|---|---|---|
| 3,217,949 | 11/1965 | Davis | 222/480 |
| 3,323,671 | 6/1967 | Minarik, Jr. et al. | 215/40 |
| 3,419,198 | 12/1968 | Pettersen | 215/224 |
| 3,836,056 | 9/1974 | Pehr | 222/480 |
| 3,845,872 | 11/1974 | Town et al. | 215/9 |
| 3,850,350 | 11/1974 | Towns et al. | 222/556 |
| 4,010,875 | 3/1977 | Babiol | 222/517 |
| 4,127,221 | 11/1978 | Vere | 222/543 |
| 4,158,902 | 6/1979 | Chernack et al. | 222/498 |
| 4,209,100 | 6/1980 | Uhlig | 215/216 |
| 4,220,248 | 9/1980 | Wilson et al. | 215/235 |
| 4,244,495 | 1/1981 | Lorscheid | 222/153 |
| 4,261,480 | 4/1981 | Bush et al. | 222/517 |
| 4,291,818 | 9/1981 | Nozawa et al. | 220/335 |
| 4,369,901 | 1/1983 | Hidding | 222/480 |
| 4,371,095 | 2/1983 | Montgomery et al. | 222/153 |
| 4,457,458 | 7/1984 | Heinol | 222/498 |

*Primary Examiner*—Joseph J. Rolla
*Assistant Examiner*—Kenneth Noland
*Attorney, Agent, or Firm*—Charles E. Brown

[57] ABSTRACT

This relates to the provision of latch mechanisms for a dispensing closure of the type having a well formed in the top wall thereof with the well being of a stepped bottom construction and there being a closure member which includes a hinge strap and a cover panel with the cover panel having an outline generally corresponding to that of the well and being divided by a transverse hinge line into a cover element and an opener. when the opener is depressed, the cover element automatically swings to an upstanding position uncovering a dispensing opening or openings. Latch mechanisms are provided to retain the opener within the well and to retain the cover element in an upstanding out-of-the-way dispensing position. This abstract is not to be construed as limiting the claims of the application.

20 Claims, 11 Drawing Figures

FIG.1
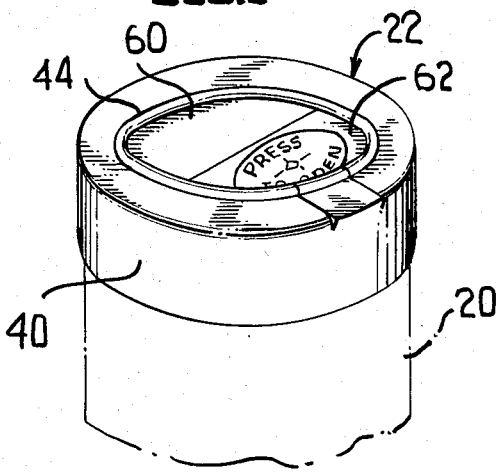
FIG.4
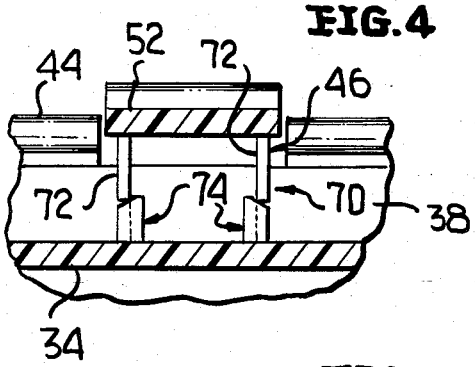
FIG.5
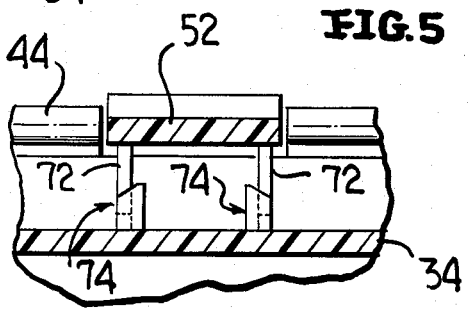
FIG.2
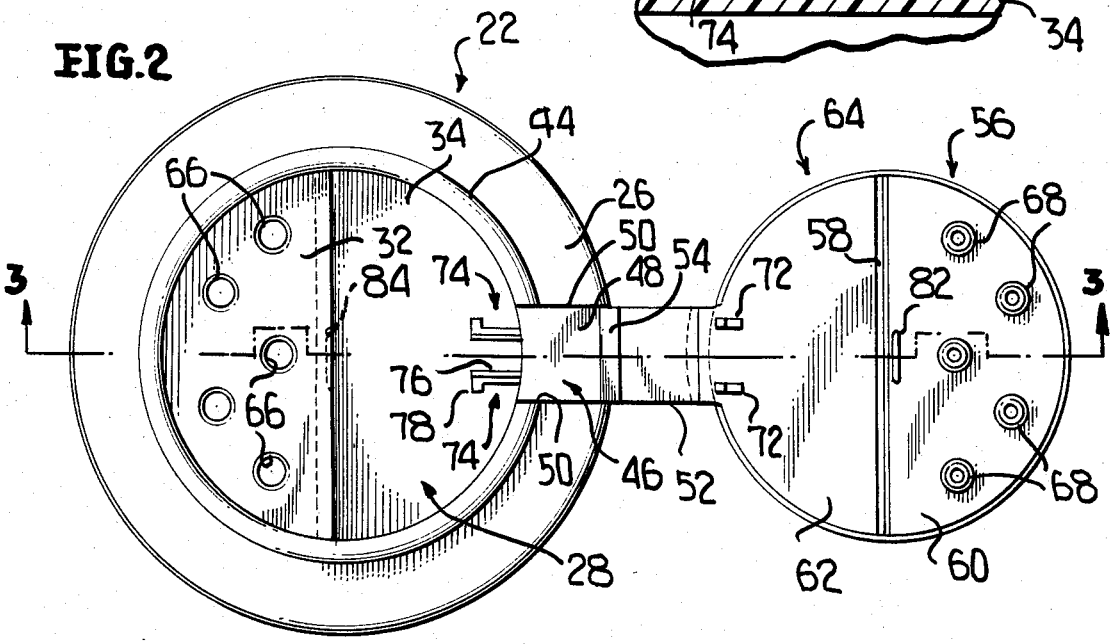
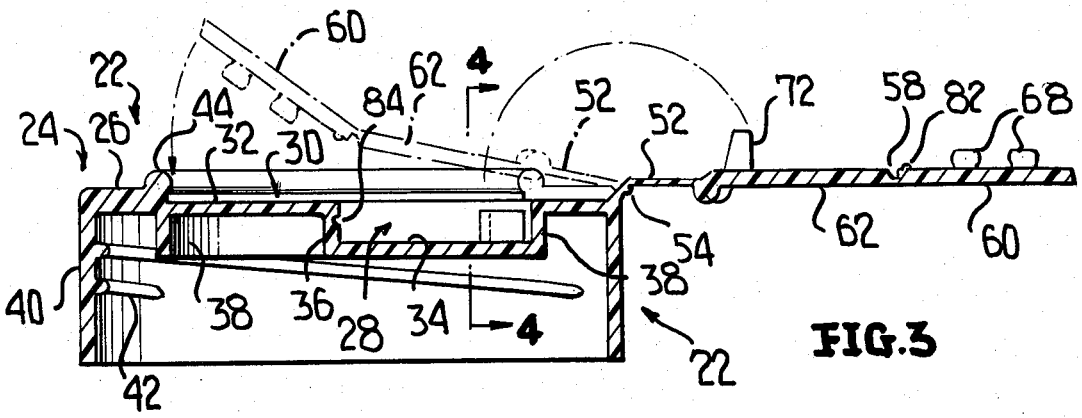
FIG.3

DISPENSING CLOSURE WITH LATCH MECHANISM

This invention relates in general to new and useful improvements in dispensing closures for containers, and more particularly relates to a latch mechanism for retaining portions of the closure in operating positions.

This invention in particular relates to an improvement over U.S. Pat. No. 3,850,350 granted Nov. 26, 1974 to Edward J. Towns, et al.

A dispensing closure of the type disclosed in the Towns et al patent includes a cover panel having a hinge dividing the cover panel into a cover element and an opener. In accordance with the Towns et al invention, the opener should only be depressed generally within the confines of the closure while the cover element will pivot relative to the opener through an angle on the order of 90° to an upstanding position uncovering dispensing openings of the closure. This invention particularly relates to a latch mechanism for normally preventing movement of the opener out of its operating environment.

With the above and other objects in view that will hereinafter appear, the nature of the invention will be more clearly understood by reference to the following detailed description, the appended claims, and the several views illustrated in the accompanying drawings:

IN THE DRAWINGS

FIG. 1 is a fragmentary top perspective view of the closure applied to a container, and shows generally the details thereof.

FIG. 2 is enlarged top plan view of the dispensing closure of FIG. 1, with the cover member in a fully open as molded condition.

FIG. 3 is a vertical sectional view taken generally along the line 3—3 of FIG. 2, and shows specific details of the closure, the cover member also being shown in phantom lines being moved toward a closing position.

FIG. 4 is an enlarged fragmentary sectional view taken generally along the line 4—4 of FIG. 3, and shows the relationship of cooperating latch mechanisms carried by the cover member and the body of the closure in a position moving toward engagement.

FIG. 5 is an enlarged fragmentary sectional view similar to FIG. 4, and shows the latch mechanisms engaged.

Figure 6:
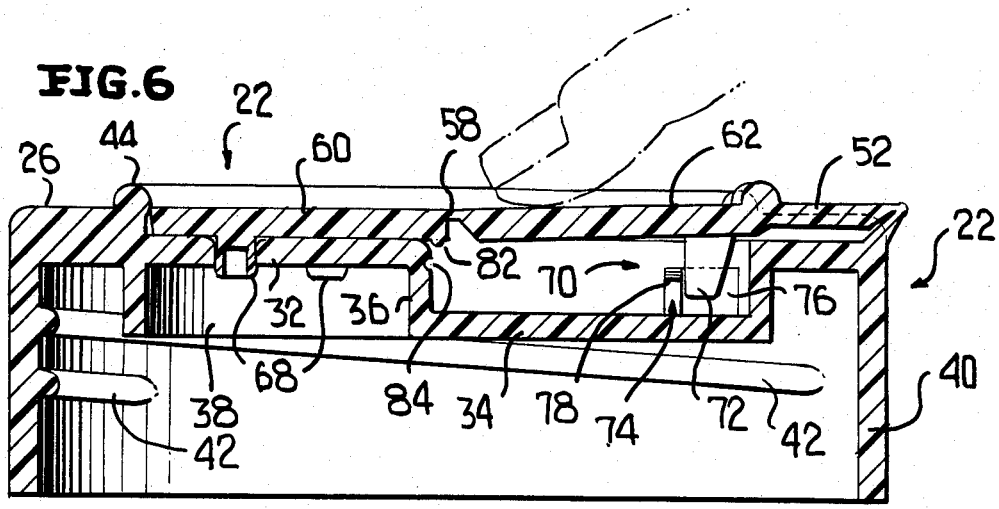
FIG. 6 is an enlarged transverse vertical sectional view somewhat similar to FIG. 3, showing the closure in its fully closed position and with one's finger in position for initiating opening.

Referring now to the drawings in detail, it will be seen that there is illustrated in FIG. 1 a container 20 which is closed by a dispensing closure formed in accordance with this invention and generally identified by the numeral 22. Basically, the closure 22 is formed in accordance with U.S. Pat. No. 3,850,350, but is provided with latch mechanisms in accordance with this invention.

The closure 22, as is best shown in FIGS. 3 and 4, includes an end wall assembly 24 which includes a peripheral upper wall member 26 surrounding a well 28 having a stepped bottom generally identified by the numeral 30. The stepped bottom wall 30 is defined by an upper panel 32 and a lower panel 34 connected by an upright wall 36 which extends between adjacent edges of the upper and lower panels 32, 34. The well 28 is also provided with an upstanding peripheral wall 38.

The peripheral upper wall member 26 is provided with an integral depending skirt 40 having formed on the inner surface thereof securing means 42 which are illustrated as being in the form of threads.

If desired, there may be an upstanding rib 44 along the juncture between the peripheral upper wall member 26 and the walls defining the well 28.

The peripheral upper wall member 26 and the rib 44, as is best shown in FIG. 2, are provided with a notch 46 defined by a bottom wall 48 and upstanding walls 50. At the peripherally outer end of the notch 46 there is a hinge strap 52 integrally molded to the closure with the hinge strap 52 being joined to the closure at the intersection of the wall 48 and the skirt 40, as is best shown in FIG. 3, by a tangential hinge 54.

The hinge strap 52 carries a circular cover panel generally identified by the numeral 56. The circular cover panel 56 is provided on the underside thereof with a transverse hinge line 58 which divides the cover panel 56 into a cover element 60 and an opener 62, the cover panel 56, together with the hinge strap, defining a cover member generally identified by the numeral 64.

In order that the closure 22 may function as a dispensing closure, the upper panel 32 is provided with a plurality of dispensing openings 66 which are arranged as shown in FIG. 2. In order to effect the closing of the dispensing openings 66, the cover element 66 is provided with a plurality of projections 68 on the underside thereof. The projections 68 are of a configuration so as to fit into the openings and to seal the openings when the closure is in its closed position.

It is to be understood that the cover panel 56 has an outline corresponding generally to that of the well 28 so as generally to seal off the well when the closure is in its closed position.

Figure 7:
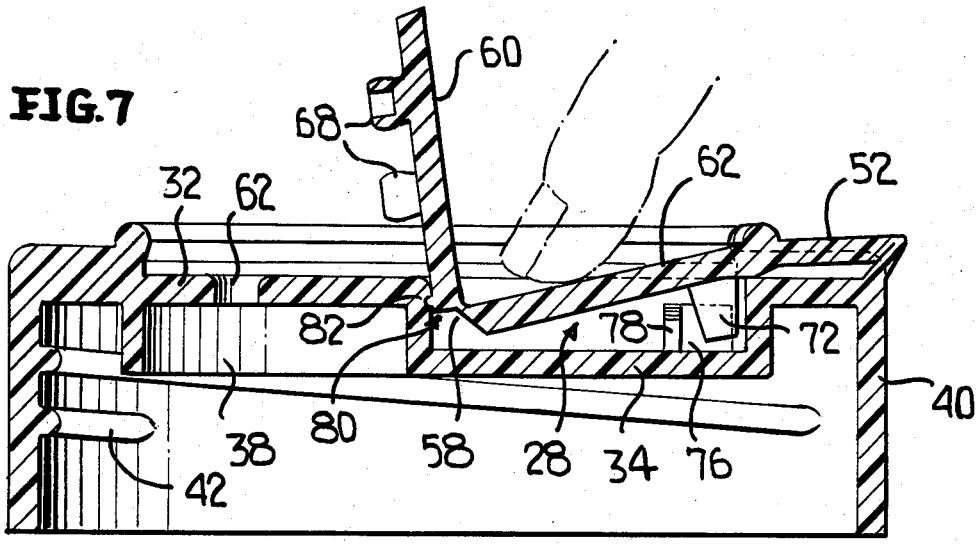
FIG. 7 is a sectional view similar to FIG. 6, and shows the mechanism in its open position ready for product dispensing.
Figure 8:
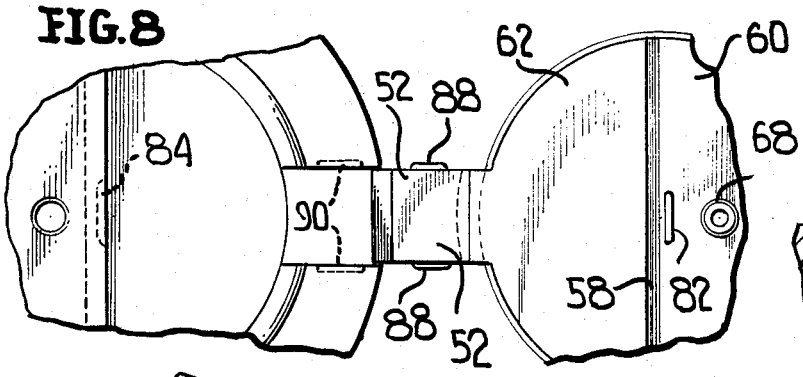
FIG. 8 is a fragmentary top plan view similar to FIG. 2, but with a modified form of latch mechanism.
Figure 10:
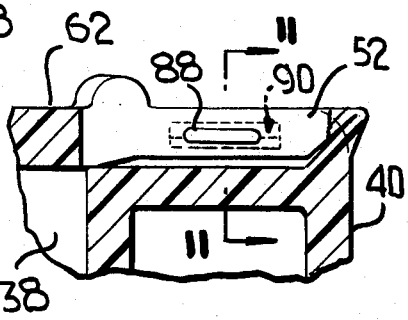
FIG. 10 is an enlarged fragmentary sectional view somewhat similar to FIG. 9, and showing the cover member in its fully closed position and the latch mechanism of FIG. 8 engaged.
Figure 9:
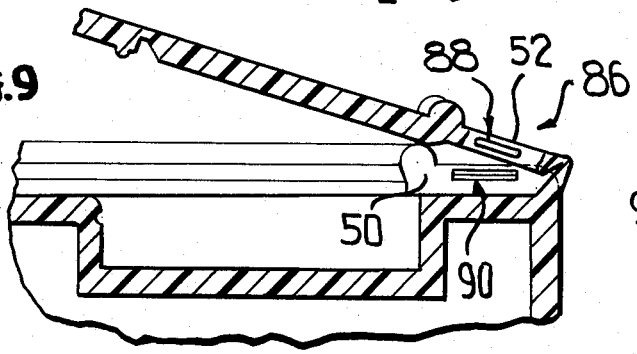
FIG. 9 is a fragmentary longitudinal sectional view showing the cover member approaching a closed position.

This invention resides in latch mechanisms which will retain the opener 62 in its generally closed position while permitting the closure elements 60 to pivot to an upstanding position clearing the upper panel 32 and the openings 66 formed therein for the dispensing of a product as is shown in FIG. 7.

The latch mechanism includes a latch mechanism generally identified by the numeral 70 between the opener 62 and the lower panel 34, as is best shown in FIGS. 4 and 6. The latch mechanism 70 includes a pair of transversely spaced depending latch elements 72 formed on the underside of the opener 62 adjacent its connection to the hinge strap 52. These latch elements 72 cooperate with upstanding latch members 74 carried by the lower panel 34. Each latch member 74 is generally L-shaped in outline, as is best shown in FIG. 2, and includes a radial leg 76 which is disposed parallel to respective latch elements 72 and a transverse leg 78 which is outwardly directed and generally normal to the leg 76 so that each latch member 74 is generally L-shaped in plan.

As will be apparent from FIG. 6, each latch element 72 is locked behind the respective leg 78 with a camming action permissible due to the resiliency of the material from which the closure 22 is formed. Further, as is clearly shown in FIGS. 4 and 5, the latch elements 72 are disposed outwardly of and in frictional sliding engagement with the legs 76.

It is to be understood that the latch elements 72 may be forcibly snapped behind the legs 78 to the position shown in FIG. 6. When they are so positioned, the latch mechanism or means 70 serve normally to prevent the opener 62 from moving behond the position illustrated in FIG. 6. However, the latch mechanism 70 in no way precludes the depressing of the opener 62 so as to snap the closure element 60 from its position overlying the upper panel 32 as shown in FIG. 6 to a generally upstanding position as shown in FIG. 7. It is also to be understood that the force exerted on the closure panel 60 by the opener 62 will be sufficient to disengage the projections or plug members 68 from the upper panel 32.

The closure 22 is provided with a second latch mechanism which is best shown in FIG. 7 and is identified by the numeral 80. The latch mechanism 80 includes a projecting depending rib 82 on the underside of the cover panel 60 adjacent the hinge line 58 and a recess 84 in an upper part of the transverse wall 36. As is best shown in FIG. 2, the projection or rib 82 is of a limited extent. The same is true of the recess 84.

When the opener 62 is depressed in the normal opening of the closure 22, the cover element 60 will pivot relative to the hinge line 58 and will move slightly down into the well 28 behond its original position with the rib 82 moving into the recess 84. The latch mechanism 80 thus engaged serves to lock the cover element 60 in a generally upstanding position as shown in FIG. 7.

When it is desired to reclose the closure 22, the cover element 60 is manually pushed back down to its original position of FIG. 6. At the same time, the opener 62 will swing up to its original position of FIG. 6 and be restrained from further movement by the latch mechanism 70.

Figure 11:
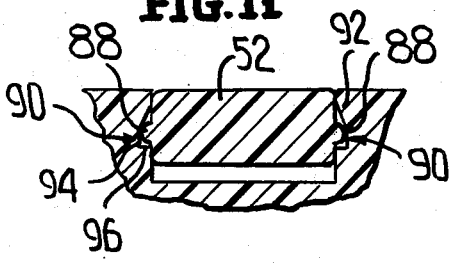
FIG. 11 is an enlarged fragmentary transverse vertical sectional view taken generally along the line 11—11 of FIG. 10, and shows specifically the details of this form of latch mechanism.

In FIGS. 8–11 there is illustrated a modified form of latch mechanism which may replace the latch mechanism 70. This latch mechanism is generally identified by the numeral 86 and includes projecting ribs 88 along the upper longitudinal faces of the hinge strap 52. The latch mechanism 86 also includes companion recesses 90 formed in the walls 50 of the notch 46. Referring particularly to FIG. 11, it will be seen that the ribs 88 are of a generally rounded cross section while the recesses 90 have a sloping upper wall 92 which terminates in a generally vertical wall 94 and which vertical wall 94 terminates in a horizontal wall or stop 96. The sloping upper wall 92 thus forms an undercut of downwardly increasing depth. Thus, when the closure member 64 is moved to its closed position, such as that shown in FIG. 10, the ribs 88 will automatically snap into the recesses 90 and lock the hinge strap 52 and thus the opener 62 generally in its closed position.

At this time it is pointed out that the projection or rib 82 is also of a generally rounded cross section, but because it pivots into the recess 84, the recess 84 may also be of a generally rounded companion cross section.

It is to be understood that the latch mechanism 86 may be utilized in combination with the latch mechanism 80. On the other hand, it is to be understood that the latch mechanism 86 in no way precludes the depressing of the opener 62 so as to snap the closure element 60 from its position overlying the upper panel 32 to a generally upstanding position as shown in FIG. 7.

Although only several preferred embodiments of latch mechanisms have been specifically illustrated and described herein, it is to be understood that minor variations may be made in the latch mechanism within the environs of the closure without departing from th spirit and scope of the invention as defined by the appended claims.

We claim:

1. A dispensing closure comprising a tubular body having means for attachment to a container, an end wall assembly including a peripheral upper wall member surrounding a well having a stepped bottom, said stepped bottom including an upper panel having at least one dispensing opening therethrough, a lower panel, and an upright wall extending between adjacent edges of said upper and lower panels, a notch in an upper surface of said peripheral upper wall member, and a cover member including a hinge strap hingedly connected to said upper panel at an outer end of said notch, said hinge strap normally extending inwardly through said notch and terminating in a cover panel of an outline corresponding generally to that of said well, said cover panel having on an underside thereof a hinge forming weakened line aligned with said upright wall and dividing said cover panel into a cover element and an opener, said upright wall forming a pivot for said cover panel wherein when said opener is depressed said cover panel will pivot to an upright position uncovering said upper panel to permit dispensing therethrough, and latch means for normally preventing movement of said opener out of said well, and for retaining said cover panel in an open and upright position when said opener is depressed into said well.

2. A dispensing closure according to claim 1 wherein said latch means is a releasable interlock between said hinge strap and that portion of said peripheral upper wall member defining said notch.

3. A dispensing closure according to claim 2 wherein said latch means comprises cooperating latch elements in part formed on an underside of said cover element adjacent said hinge forming weakening line and in part on said upright wall adjacent said upper panel.

4. A dispensing closure according to claim 2 wherein said latch means comprises cooperating latch elements in part formed on an underside of said cover element adjacent said hinge forming weakening line and in part on said upright wall adjacent said upper panel, said latch means including a projecting rib on the underside of said cover element parallel to and adjacent to said hinge forming weakening line so as to project towards said upright wall when said cover panel is in an upright open position, and a recess in said upright wall parallel to the plane of said upper panel and adjacent an upper edge of said upright wall.

5. A dispensing closure according to claim 1 wherein said notch has spaced opposing walls, said hinge strap has side edges generally opposing said notch walls, and said latch means being between at least one of said hinge strap side edges and an adjacent one of said notch walls.

6. A dispensing closure according to claim 1 wherein said notch has spaced opposing walls, said hinge strap has side edges generally opposing said notch walls, and said latch means being between at least one of said hinge strap side edges and an adjacent one of said notch walls and including a projection and a recess for receiving said projection.

7. A dispensing closure according to claim 6 wherein said recess is in the form of an undercut of downwardly increasing depth.

8. A dispensing closure according to claim 6 wherein said projection is generally in the form of an elongated rib having a generally rounded cross section.

9. A dispensing closure according to claim 1 wherein said notch has spaced opposing walls, said hinge strap has side edges generally opposing said notch walls, and said latch means being between at least one of said hinge strap side edges and an adjacent one of said notch walls and including a projection extending along each side edge of said hinge strap and projecting outwardly from the respective side edge and a recess formed in and extending along each of said walls of said notch for interlockingly receiving an associated one of said projections.

10. A dispensing closure according to claim 9 wherein said latch means comprises cooperating latch elements in part formed on an underside of said cover element adjacent said hinge forming weakening line and in part on said upright wall adjacent said upper panel.

11. A dispensing closure according to claim 9 wherein said latch means comprises cooperating latch elements in part formed on an underside of said cover element adjacent said hinge forming weakening line and in part on said upright wall adjacent said upper panel, said latch means including a projecting rib on the underside of said cover element parallel to and adjacent to said hinge forming weakening line so as to project towards said upright wall when said cover panel is in an upright open position, and a recess in said upright wall parallel to the plane of said upper panel and adjacent an upper edge of said upright wall.

12. A dispensing closure according to claim 1 wherein said latch means comprises cooperating latch elements in part formed on an underside of said cover element adjacent said hinge forming weakening line and in part on said upright wall adjacent said upper panel.

13. A dispensing closure according to claim 12 wherein said latch means includes depending latch elements on the underside of said opener, and cooperating latch members projecting upwardly from said lower panel.

14. A dispensing closure according to claim 1 wherein said latch means comprises cooperating latch elements in part formed on an underside of said cover element adjacent said hinge forming weakening line and in part on said upright wall adjacent said upper panel, said latch means including a projection and a recess for interlockingly receiving said projection.

15. A dispensing closure according to claim 1 wherein said latch means comprises cooperating latch elements in part formed on an underside of said cover element adjacent said hinge forming weakening line and in part on said upright wall adjacent said upper panel, said latch means including a projecting rib on the underside of said cover element parallel to and adjacent to said hinge forming weakening line so as to project towards said upright wall when said cover panel is in an upright open position, and a recess in said upright wall parallel to the plane of said upper panel and adjacent an upper edge of said upright wall.

16. A dispensing closure according to claim 15 wherein said latch means includes depending latch elements on the underside of said opener, and cooperating latch members projecting upwardly from said lower panel.

17. A dispensing closure according to claim 1 wherein said latch means includes depending latch elements on the underside of said opener, and cooperating latch members projecting upwardly from said lower panel.

18. A dispensing closure according to claim 17 wherein said latch members are L-shaped and each has a leg parallel to said latch elements and a leg normal to said latch elements.

19. A dispensing closure according to claim 18 wherein said latch means comprises cooperating latch elements in part formed on an underside of said cover element adjacent said hinge forming weakening line and in part on said upright wall adjacent said upper panel, said latch means including a projecting rib on the underside of said cover element parallel to and adjacent to said hinge forming weakening line so as to project towards said upright wall when said cover panel is in an upright open position, and a recess in said upright wall parallel to the plane of said upper panel and adjacent an upper edge of said upright wall.

20. A dispensing closure comprising a tubular body having means for attachment to a container, an end wall assembly including a peripheral upper wall member surrounding a well having a stepped bottom, said stepped bottom including an upper panel having at least one dispensing opening therethrough, a lower panel, and an upright wall extending between adjacent edges of said upper and lower panels, a notch in an upper surface of said peripheral upper wall member, and a cover member including a hinge strap hingedly connected to said upper panel at an outer end of said notch, said hinge strap normally extending inwardly through said notch and terminating in a cover panel of an outline corresponding generally to that of said well, said cover panel having on an underside thereof a hinge forming weakened line aligned with said upright wall and dividing said cover panel into a cover element and an opener, said upright wall forming a pivot for said cover panel wherein when said opener is depressed said cover panel will pivot to an upright position uncovering said upper panel to permit dispensing therethrough, and latch means for normally preventing movement of said opener out of said well, said latch means including depending latch elements on the underside of said opener, and cooperating latch members projecting upwardly from said lower panel, said latch members being L-shaped and each having a leg parallel to said latch elements and a leg normal to said latch elements, and each latch element cammingly engaging said normal leg of the respective one of said latch members.

* * * * *